US006006982A

United States Patent [19]

Jones

[11] Patent Number: 6,006,982

[45] Date of Patent: Dec. 28, 1999

[54] DUAL PACKAGE CONTAINER FORMED FROM SINGLE-PIECE BLANK

[76] Inventor: Benjamin M. Jones, 522 Lottie Ave., Modesto, Calif. 95354

[21] Appl. No.: 09/072,513

[22] Filed: May 4, 1998

[51] Int. Cl.[6] ..... B65D 5/54

[52] U.S. Cl. ..... 229/120.011; 229/120.18

[58] Field of Search ..... 229/120.011, 120.012, 229/120.09, 120.11, 120.18

[56] References Cited

U.S. PATENT DOCUMENTS

| | | | |
|---|---|---|---|
| 1,318,124 | 10/1919 | Wright | 229/120.012 |
| 2,984,402 | 5/1961 | Putnam | 229/120.38 |
| 3,048,321 | 8/1962 | Sanford | 229/120.011 |
| 3,082,929 | 3/1963 | Aquino et al. | 229/120.12 |
| 3,158,312 | 11/1964 | Simkins | 229/120.11 |
| 4,314,639 | 2/1982 | Gloyer . | |
| 4,913,291 | 4/1990 | Schuster | 229/120.011 |
| 5,129,575 | 7/1992 | Bryan | 229/120.011 |
| 5,318,223 | 6/1994 | Gale . | |
| 5,419,471 | 5/1995 | Polumbaum . | |
| 5,524,815 | 6/1996 | Sheffer | 229/120.18 |
| 5,645,164 | 7/1997 | Werth . | |
| 5,678,695 | 10/1997 | Ridgeway . | |
| 5,722,583 | 3/1998 | Focke et al. | 229/120.11 |
| 5,758,818 | 6/1998 | Ewing, Jr. | 229/120.011 |

*Primary Examiner*—Gary E. Elkins

*Attorney, Agent, or Firm*—The Law Offices of Bever & Hoffman, LLP

[57] ABSTRACT

A dual package container formed from a single-piece blank that is separable, for example, from a standard twelve-bottle container into first and second six-bottle packages. The first package includes an inner wall that is connected across a first fold line located along its lower edge to the inner wall of the second package. Tabs extending from top and bottom flaps of the first package are glued to corresponding top and bottom flaps of the second package. The tabs are attached the top and bottom flaps of the first package across second fold lines. The first and second fold lines are perforated to facilitate tearing during a separation process in which the first package is separated from the second package. The single-piece blank includes panels that form the walls of the first and second packages. Flanges extending from inner wall panels are respectively glued to end wall panels of the first and second packages. Another flange is either formed on an end panel of the blank and glued to the inside wall panel of the first package, or formed on the inside wall panel and glued to the end panel. The single-piece blank is folded and glued using standard automated machines to form the dual package container.

18 Claims, 12 Drawing Sheets

DUAL PACKAGE CONTAINER FORMED FROM SINGLE-PIECE BLANK

FIELD OF THE INVENTION

This invention relates to the field of product packaging, boxes and containers, and more specifically to containers that can be formed and assembled using standard automated machinery.

BACKGROUND OF THE INVENTION

The packaging industry typically uses automated machines to form and assemble containers, such as corrugated cardboard boxes. For example, automated die cut machines are used to cut or punch-out blanks from sheets of corrugated cardboard. In addition, automated folder/gluer machines are used to fold and glue the blanks to form flattened (knocked-down) containers, and to erect the containers and glue the bottom flaps. Automated machines are also used to insert partitioning walls and remove/insert products (such as wine bottles) into the open-ended containers. Finally, automated machines are used to glue the top flaps of the filled containers for shipment and storage prior to retail sale.

The automated machines utilized by the packaging industry are typically optimized for containers formed with walls and flaps having predetermined sizes and shapes (hereafter "standard containers"). While such automated machines can be modified to handle non-standard containers, such modification is typically expensive, thereby increasing the overall cost of the contained products. However, product manufacturers occasionally encounter situations in which the use of non-standard containers is unavoidable. One such situation involves the export of wine from the U.S. to Europe.

Modern wine production utilizes highly automated processes during which wine is bottled, for example, in 750 ml (milliliter) bottles, and distributed throughout the world using standard containers (e.g., corrugated cardboard boxes having specific dimensions). Wine producers often utilize machines to automatically fill and cork their wine in 750 ml wine bottles, and to automatically insert the bottles into containers for distribution.

In the U.S., automated machines are used to bottle wine in 750 ml bottles in standard twelve bottle containers. Typically, these twelve bottle containers are cut, folded and glued by a container manufacturer, and shipped to a glass house in a predetermined flattened (knocked-down) state. At the glass house, the flattened twelve bottle containers are automatically erected, the bottom flaps of the container are glued and partition walls inserted that divide the container into twelve compartments in a three-by-four arrangement. Twelve empty bottles are then inserted into each container, and then the containers are transported from the glass house to a wine producer. The wine producer utilizes automated machines to remove the empty bottles from the containers, and to fill, seal and label the bottles. The filled bottles are then automatically re-inserted into the container, and then the top flaps of the containers are automatically closed and glued.

A problem arises when U.S. wine producers wish to export their wine to Europe because the standard U.S. container for 750 ml wine bottles is different from that used in European. As mentioned above, U.S. glass houses and wine producers utilize automated machinery specifically configured to erect and fill U.S. standard containers that hold twelve bottles in a three-by-four arrangement. In Europe, a "standard" container holds six bottles, and therefore cannot be readily processed by the automated machines used in the U.S. Consequently, when U.S. wine producers wish to export their wine to Europe, either the automated machinery used to erect the containers and insert bottles must be modified to handle six-bottle containers, or an additional production step is required to remove the 750 ml bottles from the twelve-bottle containers, and to repackage the bottles in six-bottle containers. Modification is particularly expensive because it must be implemented in the automated machinery of the container manufacturer, the glass house and the wine producer. On the other hand, removing and repackaging wine bottles in six-bottle containers is time consuming, and typically results in the disposal of the twelve-bottle containers.

What is needed is a dual package container that has dimensions and flaps that are consistent with standard automated machinery, and can be readily separated into two discrete packages. More specifically, what is needed is a twelve-bottle standard container for 750 ml wine bottles that can be readily separated into two six-bottle packages for distribution in Europe.

SUMMARY OF THE INVENTION

The present invention is directed to a dual package container having dimensions and flaps that are consistent with standard automated machinery, and that can be readily separated into two discrete packages. The dual package container meets the needs of, for example, U.S. wine producers for a standard-sized twelve-bottle container that is easily separated into two six-bottle packages for distribution in Europe. Because the dual package container is standard-sized and has standard fold patterns, it is not necessary for glass houses and wine producers to modify the automated machines used to erect and fill conventional twelve bottle containers. Further, because the dual package container is readily separable into two six-bottle packages, the need for removing and repackaging wine bottles for distribution in Europe is eliminated. Therefore, the dual package container produced in accordance with the present invention provides a significant advantage over conventional containers by significantly reducing costs associated with packaging wine for export to Europe.

In accordance with a first aspect of the present invention, the dual package container is formed from a single-piece blank, thereby greatly facilitating manufacture using conventional automated machines. The single-piece blank is formed in a single die cutting step using conventional die cut machinery. The single-piece blank is then folded and side wall panels thereof are glued using conventional folder/gluer machines to form a flattened (knocked-down) container that is easily transportable to, for example, a glass house. Automated manufacture using conventional machinery is greatly facilitated by the single-piece blank because the various wall panels and flaps are reliably aligned during folding and gluing, thereby avoiding unusual processing steps (such as the joining of two discrete parts) or investment in special machines that greatly increase production costs.

In accordance with a second aspect of the present invention, the flattened (knocked-down) container is essentially identical to conventional containers. The walls and flaps of the flattened container facilitate erection and gluing without modification to the automated machinery used by a bottle house to process conventional containers. Further, the top flaps of the container are formed in a manner consistent with conventional containers, thereby avoiding modification of the bottle handling machinery utilized by wine producers.

By providing a dual package container that is essentially identical in profile to conventional containers, the cost exporting U.S. wine to Europe is greatly reduced over that associated with non-standard containers because modification or replacement of conventional automated machinery utilized by the glass houses and wine producers is not required.

In accordance with a third aspect of the present invention, the dual package container is separable into first and second packages by breaking or removing a joint connecting an inside wall of the first package to an inside wall of the second package. The single-piece blank is formed such that the lower edge of the inside wall panel of the first package is connected at a fold line to the lower edge of the inside wall panel of the second package. In one embodiment, the joint between the first and second package is formed by perforating this fold line to create a relatively weak connection between the inside wall panels that is strong enough to hold through the top flap gluing process, yet weak enough to break (tear) easily when separation of the first and second packages is desired. When separated, these inside wall panels form respective length walls of the first and second packages. By providing this temporary connection between the inside wall panels of the first and second packages, the length of the single-piece wrapper used to form the dual package container is minimized, thereby facilitating cutting and folding using standard automated machinery.

DETAILED DESCRIPTION OF THE DRAWINGS

Definitions

The dual package container of the present invention is described with reference to various embodiments that are disclosed in the figures. The following paragraphs provide definitions for certain terms and phrases that are utilized in the description of the various embodiments.

In the following description, the term "attached" describes the union of two separate parts using an external fastening mechanism, such as adhesive or mechanical fastener. The phrase "temporary attachment" describes a union that is intentionally broken upon separation of the dual package container into two packages. For example, a clip or other easily removable mechanical fastener that is connected between two separate members forms a temporary attachment. In contrast, the phrase "permanent attachment" describes a union that is not intentionally broken during separation of the dual package container, but may be broken when the dual package container is destroyed. For example, two members that are connected by a strong adhesive are permanently attached.

In contrast to "attached", the term "connected" describes two portions of an integrally formed single-piece blank that are joined by a common fold line during the die cut process. The phrase "temporary connection" describes a fold line that is, for example, substantially perforated such that the fold line intentionally tears or breaks during separation of the dual package container into two packages. In contrast, the term "permanent connection" describes a fold line that is either merely creased or slightly perforated during die cutting to facilitate the folding process. Similar to permanent attachments, permanent connections are not intentionally broken during separation of the dual package container, but may be broken when the dual package container is destroyed.

First Embodiment

Figure 1:
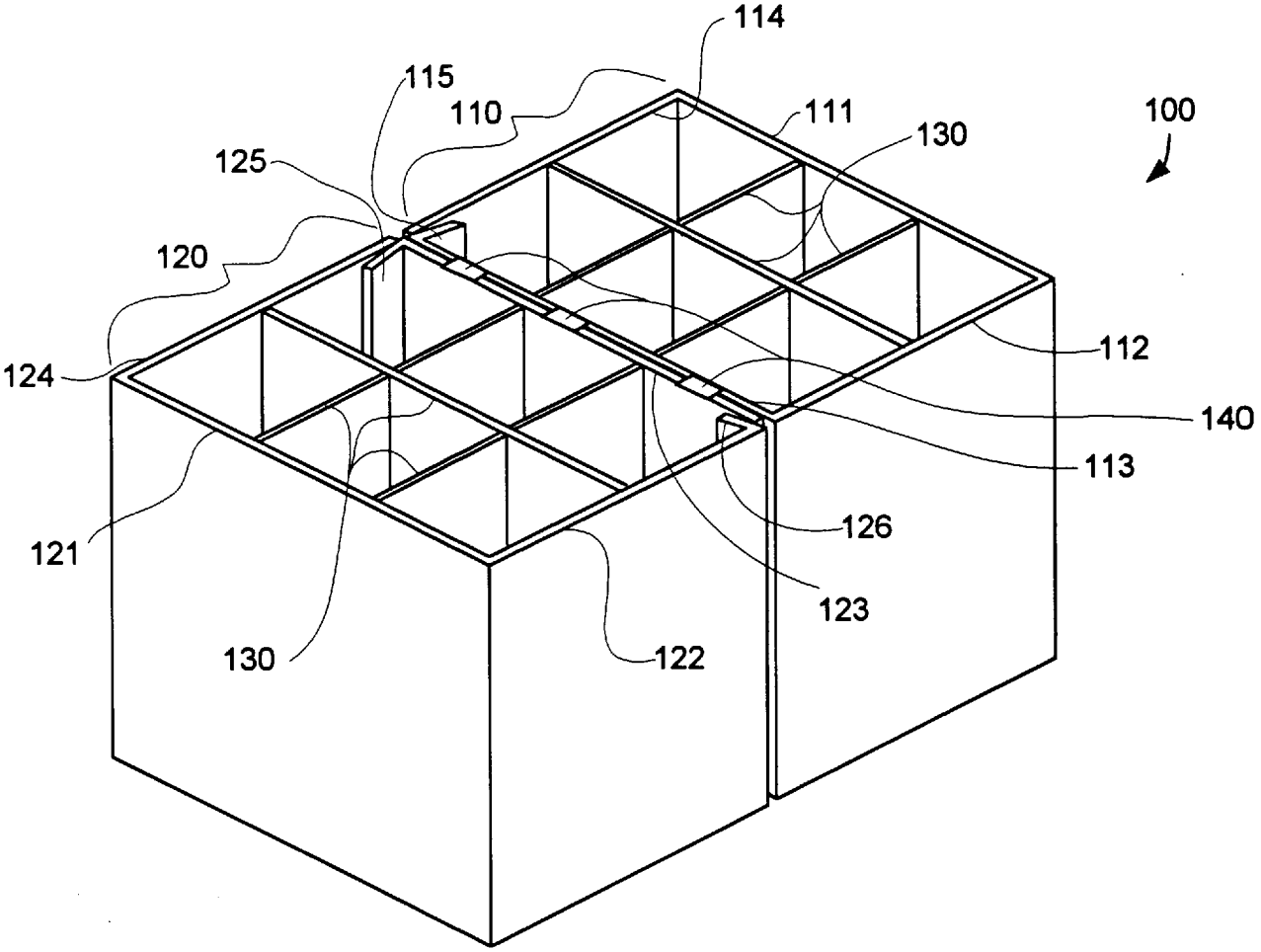
FIG. 1 is a perspective view showing a dual package container in accordance with a first embodiment of the present invention.
Figure 2B:
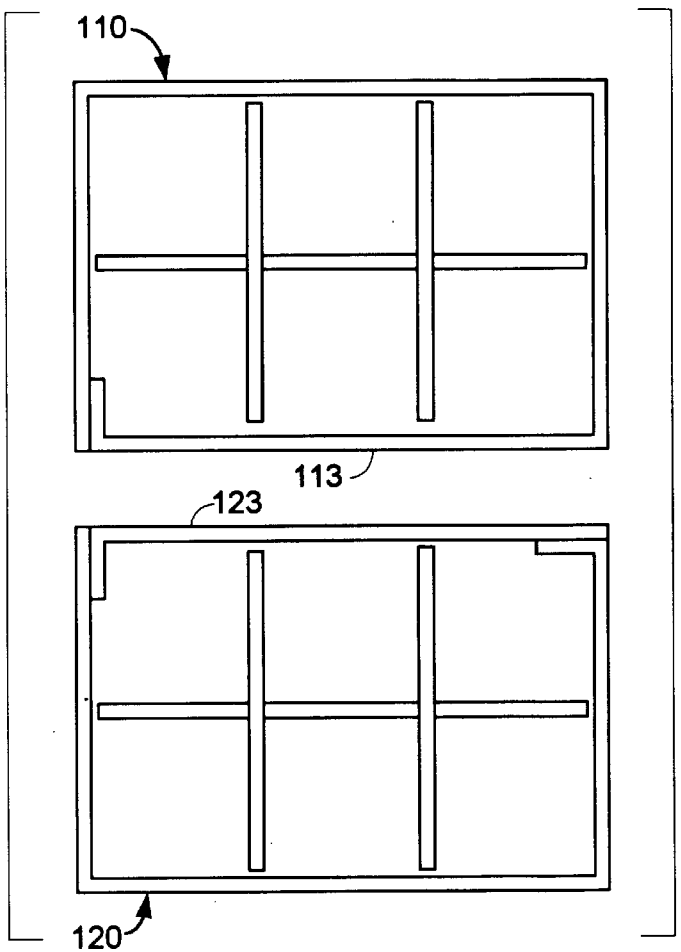
FIGS. 2(A) and 2(B) are top views of the dual package container shown in FIG. 1.
Figure 2A:
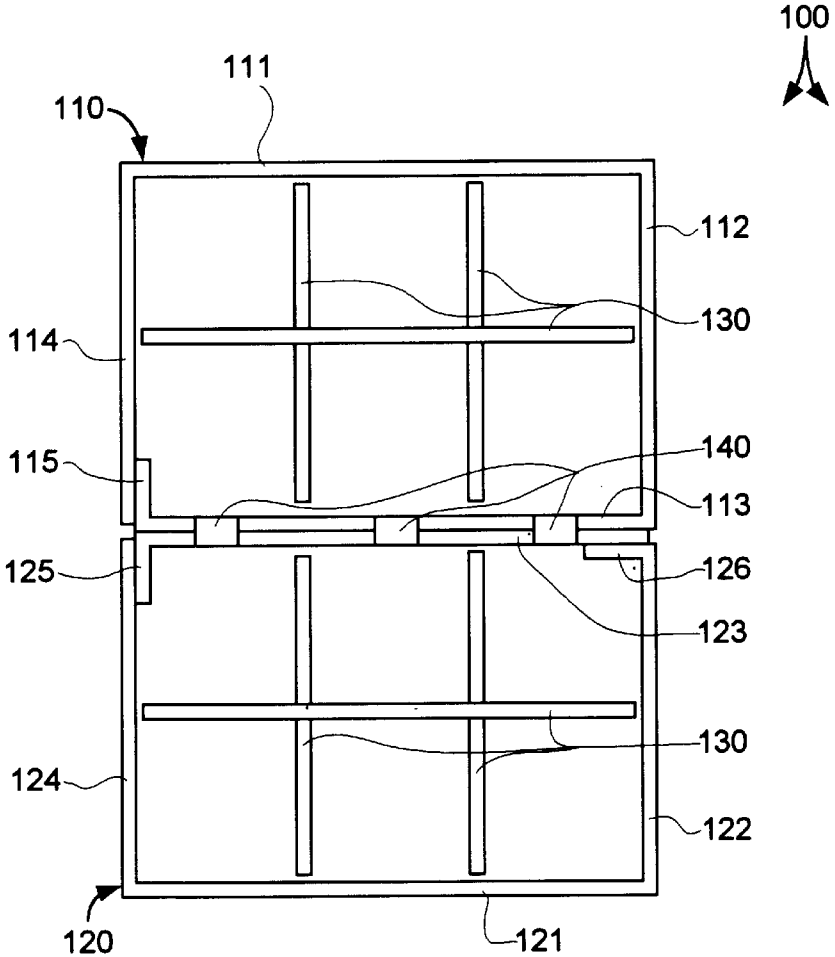

FIGS. 1, 2(A) and 2(B) show a dual package container 100 in accordance with a first embodiment of the present invention.

FIG. 1 is a perspective view of dual package container 100 that includes first package 110 and a second package 120. In the disclosed embodiment, each of first package 110 and second package 120 includes an optional set of partitioning walls 130 that divide the interior of each of these packages into six compartments. In other embodiments, partitioning walls may be used to divide each package into any number of compartments. Dual package container 100 also includes one or more temporary connections or temporary attachments (joints) 140 that join first package 110 and second package 120.

FIGS. 2(A) and 2(B) are top views of dual package container 100 respectively showing first package 110 and second package 120 in a joined and separated state.

First package 110 includes an outside wall 111, a first end wall 112, an inside wall 113, and a second end wall 114. Inside wall 113 is parallel to outside wall 111, which are perpendicular to first end wall 112 and second end wall 114. Inside wall 113 is permanently attached to second end wall 114 via a first flange 115 that is permanently connected to an edge of inside wall 113 and folded to contact the inside surface of second end wall 114. First flange 115 is permanently attached to second end wall 114 using a suitable adhesive or other fastening mechanism.

Second package 120 includes an outside wall 121, a first end wall 122, an inside wall 123, and a second end wall 124. Inside wall 123 is parallel to outside wall 121, which are perpendicular to first end wall 122 and second end wall 124. Inside wall 123 is permanently attached to second end wall 124 via a second flange 125 that is permanently connected to an edge of inside wall 123 and folded to contact the inside surface of second end wall 124. Inside wall 123 is permanently attached to first end wall 122 via a third flange 126 that is permanently connected to an edge of first end wall 122 and folded to contact the inside surface of inside wall 123. Second flange 125 and third flange 126 are respectively attached to second end wall 124 and inside wall 123 using a suitable adhesive or other fastening mechanism.

In accordance with the present invention, inside wall 113 of first package 110 is either temporarily attached or temporarily connected to inside wall 123 of second package 120 via joints 140. When joints 140 are intact, inside wall 113 of first package 110 is parallel to and abuts inside wall 123 of second package 120 such that the four edges of inside wall 113 are aligned with the four edges of inside wall 123. Joints 140 are provided along respective edges of inside wall 113 and inside wall 123, and are breakable or removable such that first package 110 and second package 120 can be separated from, for example, an integral twelve-bottle container into two six-bottle packages. In one embodiment, joints 140 are formed by intentionally weakening (e.g., perforating) the fold line material bridging inside wall 113 and inside wall 123, thereby creating a temporary connection between these walls that is broken by applying a shearing force to the intentionally weakened material. In another embodiment, joints 140 may be discrete fasteners connecting inside wall 113 and inside wall 123, thereby creating a temporary attachment between these walls that is removed by breaking or releasing the fastener, or by removing a portion of inside wall 113 and/or inside wall 123 surrounding the fastener. When joints 140 are intact, dual package 100 is essentially identical to, for example, a standard twelve-bottle container typically utilized to package wine in 750 ml bottles. Conversely, when joints 140 are broken/removed, dual package container 100 is separated into first package 110 and second package 120, each forming a six-bottle container suitable for distributing wine in Europe.

FIG. 2(B) shows dual package container 100 after joints 140 are broken/removed, thereby separating first package 110 from second package 120. Inside wall 113, which forms an interior wall of dual package container 100 when joints 140 are intact, becomes an exterior length wall of first package 110. Similarly, inside wall 123 becomes an exterior length wall of second package 120.

In accordance with an aspect of the present invention, dual package container 100 is formed from a single-piece blank, thereby greatly facilitating manufacture using conventional automated machines. This first aspect is disclosed in additional detail with reference to the second embodiment of the present invention, described below.

Second Embodiment

Figure 3:
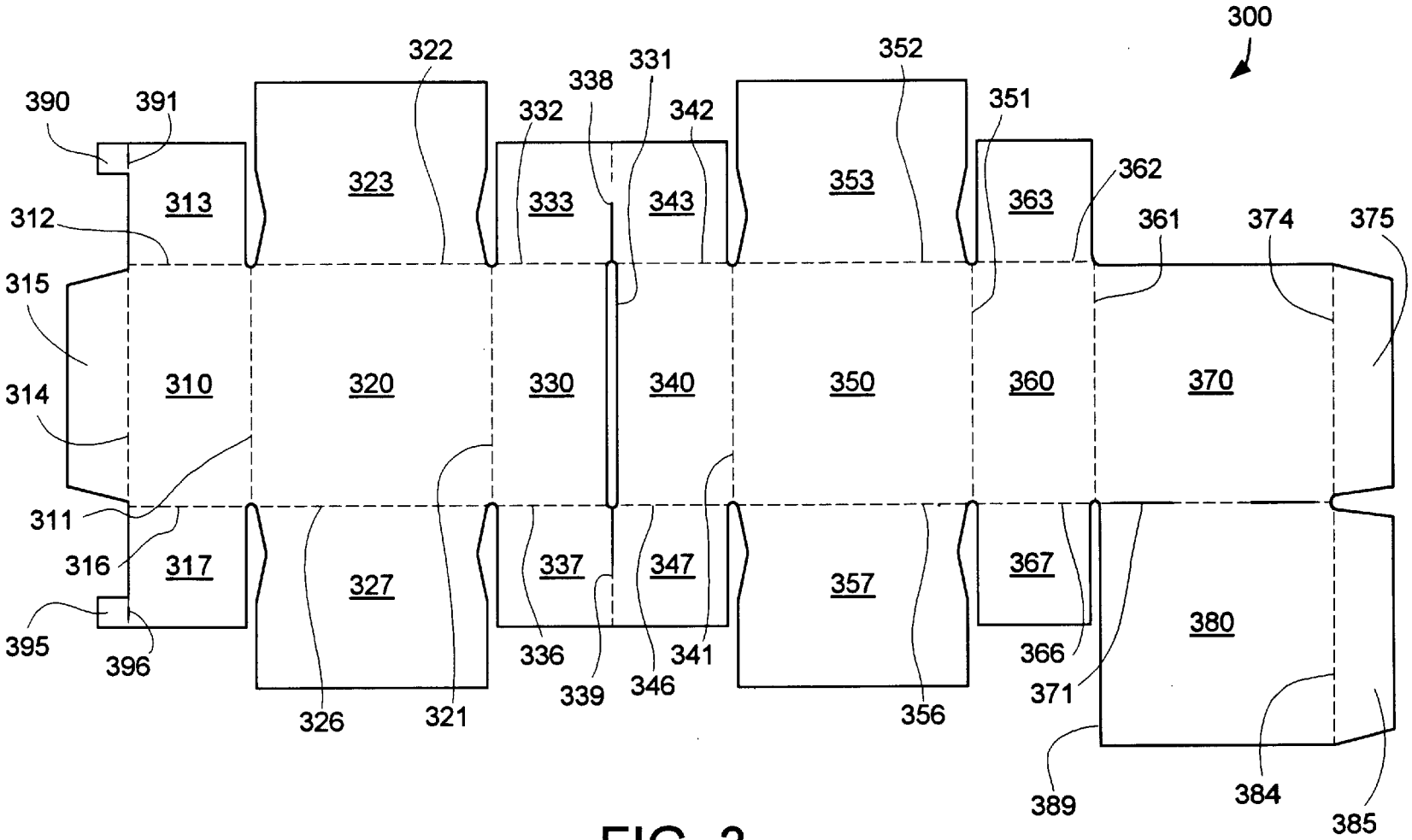
FIG. 3 is a plan view showing a single-piece blank for forming a dual package container in accordance with a second embodiment of the present invention.

FIG. 3 is a plan view of a single-piece blank 300 used to form a dual package container in accordance with the second embodiment of the invention. In FIG. 3, solid lines indicate edges and temporary connections, and dashed lines indicate permanent connections.

In one embodiment, single-piece blank 300 is formed from corrugated cardboard in a single cutting step using conventional die cut machinery, such as that manufactured by Bobst S. A. of Lausanne, Switzerland. In other embodiments, single-piece blank 300 may be formed from other suitable materials, such as solid fiber, plastic, single face or single face laminate.

Single-piece blank 300 is sectioned during the die cut process by fold lines and slots (or slits) into a series of panels that form the walls, flaps, flanges and tabs of a dual package container. These panels are described in the following paragraphs with reference to FIG. 3. In the description, the terms "vertical" and "horizontal" are used for convenience to describe relative orthogonal directions.

Single-piece blank 300 includes several main panels that form the vertical walls of a first package and a second package of the dual package container. The main panels include an end wall panel 310, an outside wall panel 320, an end wall panel 330, an end wall panel 340, and outside wall panel 350, an end wall panel 360, an inside wall panel 370, and an inside wall panel 380.

Main panels 310 through 370 are sequentially arranged horizontally along the wrapper 300, and a vertical fold line joins each adjacent pair of these main panels. Specifically, end wall panel 310 forms a first end wall of a first package of the dual package container. Outside wall panel 320 forms an outside wall of the first package, and is permanently connected to panel 310 along vertical fold line 311. End wall panel 330 forms a second end wall of the first package, and is permanently connected to panel 320 along vertical fold line 321. End wall panel 340 forms a first end wall of a second package of the dual package container, and is separated from panel 330 by a vertical slot (or slit) 331. Outside wall panel 350 forms an outside wall of the second package, and is permanently connected to panel 340 along vertical fold line 341. End wall panel 360 forms a second end wall of the second package, and is permanently connected to panel 350 along vertical fold line 351. Inside wall panel 370 forms an inside wall of the second package, and is permanently connected to panel 360 along fold line 361.

In accordance with another aspect of the present invention, side wall panel 380 forms an inside wall of the first package, and is temporarily connected to inside wall panel 370 along horizontal fold line 371. That is, unlike main panels 310 through 370 that are horizontally arranged and permanently connected along vertical fold lines, inside wall panel 380 is located below inside wall panel 370 on single-piece blank 300, and is temporarily connected via a horizontal fold line 371. By positioning inside wall panel 380 below inside wall panel 370, the (horizontal) length of single-piece blank 300 is minimized, thereby facilitating cutting and folding using standard automated machinery. In addition, inside wall panels 370 and 380 are temporarily connected together along fold line 371 such that, when a relatively weak shearing force is applied along fold line 371, the inside wall panel 380 becomes detached from inside wall panel 370, thereby separating the dual package container into two discrete, completely enclosed packages. In one embodiment, fold line 371 is perforated using known techniques such that it tears when a relatively weak shearing force is applied (i.e., relative to the shearing force necessary to break the "permanent connections" along, for example, fold line 361), thereby separating the inside wall panels 370 and 380. In another embodiment, fold line 371 may be completely severed and a removable hinge, such as a paper or fabric patch, may be attached by adhesive to inside wall panels 370 and 380 across fold line 371.

Each of the main panels 310, 320, 330, 340, 350 and 360 of single-piece blank 300 is permanently connected to secondary panels that that form the top and bottom flaps of the dual package container. Specifically, a top flap panel 313 forms a first outside top flap of the first package, and is connected to end wall panel 310 along horizontal fold line 312. Bottom flap panel 317 forms a first outside bottom flap of the first package, and is connected to end wall panel 310 along horizontal fold line 316. Top flap panel 323 forms an inside top flap of the first package, and is connected to outside wall panel 320 along horizontal fold line 322. Bottom flap panel 327 forms an inside bottom flap of the first package, and is connected to outside wall panel 320 along horizontal fold line 326. Top flap panel 333 forms a second inside top flap of the first package, and is connected to end wall panel 330 along horizontal fold line 332. Bottom flap panel 337 forms a second outside bottom flap of the first package, and is connected to end wall panel 330 along horizontal fold line 336. Top flap panel 343 forms a first top outside flap of the second package, and is connected to end wall panel 340 along horizontal fold line 342. Bottom flap panel 347 forms a first bottom outside flap of the second package, and is connected to end wall panel 340 along horizontal fold line 346. Top flap panel 353 forms a top inside flap of the second package, and is connected to outside wall panel 350 along horizontal fold line 352. Bottom flap panel 357 forms a bottom inside flap of the second package, and is connected to outside wall panel 350 along horizontal fold line 356. Top flap panel 363 forms a second top outside flap of the second package, and is connected to end wall panel 360 along horizontal fold line 362. Bottom flap panel 367 forms a second outside bottom flap of the second package, and is connected to end wall panel 360 along horizontal fold line 366.

In accordance with another aspect of the present invention, inside wall panels 370 and 380 are respectively provided with flanges (e.g., elongated glue tabs) that are utilized to permanently attach the inside wall panels 370 and 380 to end walls of the first and second packages. A first flange 375 is permanently connected to inside wall panel 370 along vertical fold line 374, and is permanently attached (as discussed below) to end wall panel 340 during the formation of the second package. A second flange 385 is permanently connected to inside wall panel 380 along vertical fold line 384, and is permanently attached (as discussed below) to end wall panel 330 during the folding and gluing process.

In addition to the flanges provided on inside wall panels 370 and 380, a third flange 315 is provided on end wall panel 310 along vertical fold line 314. As discussed below, third flange 315 is permanently attached to inside wall panel 380 during the folding and gluing process.

In accordance with another aspect of the present invention, top flap panel 313 and bottom flap panel 317 are respectively temporarily attached to top flap panel 363 and bottom flap panel 367 to facilitate folding by standard automated machinery. Specifically, a first tab 390 extends from top flap panel 313 along vertical fold line 391, and is permanently attached to top flap panel 363 (as discussed below) during the folding and gluing process. Similarly, a second tab 395 extends from bottom flap panel 317 along fold line 396, and is permanently attached to bottom flap panel 367 (as discussed below) during the folding and gluing process. By attaching top flap panels 313 and 363 and bottom flap panels 317 and 367 using tabs 390 and 395, the combined panel structures are consistent with the outside major flaps of conventional containers, thereby preventing alteration of conventional folder/gluer machinery. For example, first tab 390 attaches top flap panel 313 and top flap panel 363 to form a combined panel that is processed as a single major flap of the dual package container by the folder/gluer machinery used by glass houses and wine producers.

In accordance with another aspect, first tab 390 is temporarily connected or temporarily attached to top flap panel 313 along vertical fold line 391, and is permanently attached to top flap panel 363 (as discussed below) during the formation of the first package. In addition, a second tab 395 is temporarily connected or temporarily attached to bottom flap panel 317 along fold line 396, and is permanently attached to bottom flap panel 367 (as discussed below) during the folding and gluing process. In accordance with one embodiment, fold lines 391 and 396 are perforated using known techniques such that tabs 390 and 395 become separated from top flap panel 313 and bottom flap panel 317 in response to the application of a relatively weak shearing. In another embodiment, fold lines 391 and 396 may be completely severed and a removable hinge, such as a paper or fabric patch, may be attached by adhesive to connect tabs 390 and 395 to top flap panel 313 and bottom flap panel 317, respectively. By breaking these temporary connections/attachments, top flap panels 313 and 363 are separated, as are bottom flap panels 317 and 367, thereby allowing the dual package container to be separated into discrete first and second containers.

In accordance with another aspect of the present invention, top flap panel 333 and bottom flap panel 337 are respectively temporarily connected or temporarily attached to top flap panel 343 and bottom flap panel 347. In one embodiment, top flap panel 333 is temporarily connected to top flap panel 343 along fold line 338, which is perforated such that it tears in response to a relatively weak shearing force. Similarly, bottom flap panel 337 is temporarily connected to bottom flap panel 347 along fold line 339, which is perforated such that it tears in response to a relatively weak shearing force. In another embodiment, fold lines 338 and 339 are completely severed and a removable hinge, such as a paper or fabric patch, is attached using adhesive to connect top flap panels 333 and 343 and bottom flap panels 337 and 347, respectively. By breaking these temporary connections, top flap panels 313 and 363 are separated, as are bottom flap panels 317 and 367, thereby allowing the dual package container to be separated into the first and second containers.

In one embodiment, the panels of single-piece blank 300 are formed to produce a dual package container suitable for storing twelve wine bottles having diameters of 3 inches, and lengths of approximately twelve inches. To produce a dual package container meeting this specification, the panels of blank 300 are sized to the following approximate dimensions. End wall panels 310 and 360 are approximately six and three-fourths (6¾) inches wide and twelve inches in length. Outside wall panels 320 and 350 are approximately ten inches wide and twelve inches in length. End wall panels 330 and 340 are approximately six and one-fourth (6¼) inches wide and twelve inches in length. Inside wall panels 370 and 380 are approximately ten inches wide and 12 inches in length. Top flap panels 313 and 363 and bottom flap panels 317 and 367 are approximately six and one-half (6½) inches wide and six and three-fourths (6¾) inches in length. Top flap panels 323 and 353 and bottom flap panels 327 and 357 are approximately nine and three-fourths (9¾) inches wide and six and three-fourths (6¾) inches in length. Top flap panels 333 and 343 and bottom flap panels 337 and 347 are approximately six and five-eighths inches wide and five and one-eighth inches in length. First flange 375, second flange 385 and third flange 315 are each approximately two inches wide, and are slightly tapered at each end to facilitate the folding and gluing process.

FIGS. 4 through 10(B) illustrate a folding and gluing process whereby single-piece blank 300 is folded into a flattened (knocked-down) state that is suitable for storage and shipment to, for example, a glass house. The folding and gluing process is performed using conventional folder/gluer machines, such as those manufactured by Bobst S. A. of Lausanne, Switzerland.

Figure 4:
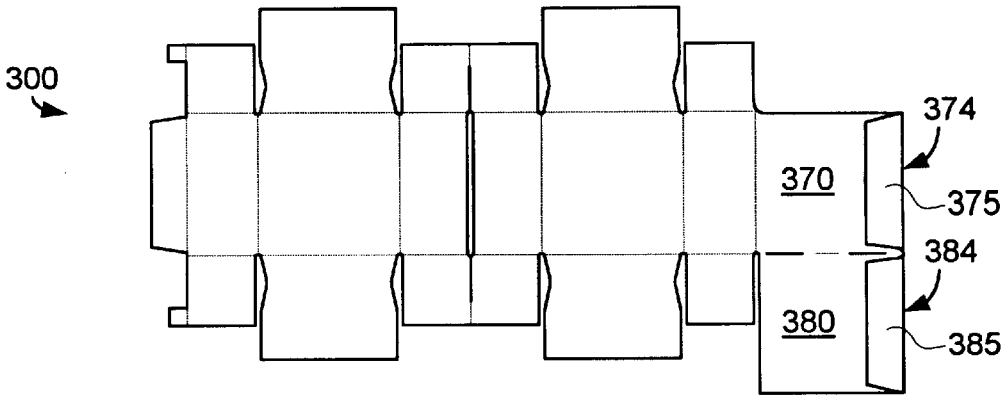
FIG. 4 is a plan view of the single-piece blank associated with the first embodiment after a first step of a folding and gluing process.

FIG. 4 shows a first folding step during which first flange 375 and second flange 385 are folded 180 degrees. Specifically, first flange 375 is folded along fold line 374 until first flange 375 contacts inside wall panel 370. At the same time, second flange 385 is folded along fold line 384 until second flange 385 contacts inside wall panel 380. In the folded state, the outside (lower) surface of first flange 375 and second flange 385 face upward.

Figure 5:
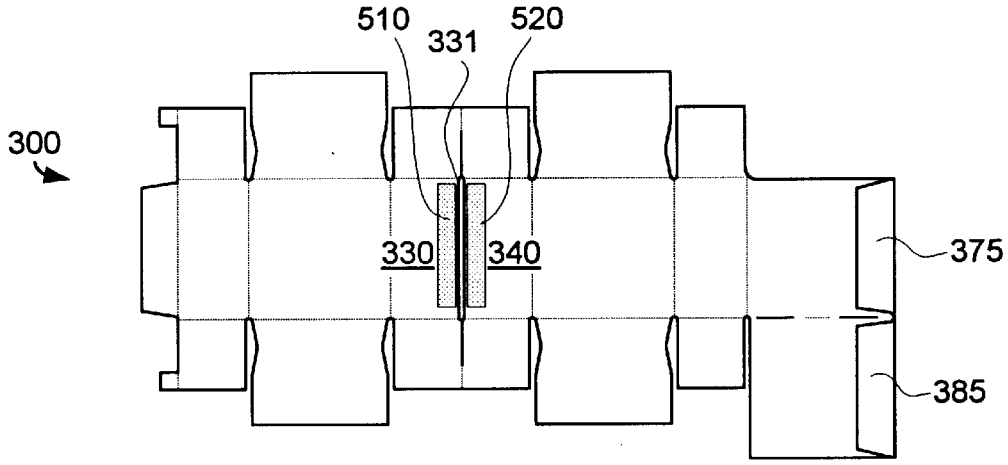
FIG. 5 is a plan view of the single-piece blank associated with the first embodiment after a second step of a folding and gluing process.

FIG. 5 shows a first gluing step in which glue is applied for permanently attaching first flange 375 and second flange 385 to end wall 340 and end wall 330, respectively. In one embodiment, glue patch (adhesive portion) 510 is applied to the inside (upper) surface of end wall panel 330 along slot 331 in pattern suitable for securing second flange 385. Similarly, glue patch 520 is applied on end wall panel 340 along slot 331 in pattern suitable for securing first flange 375. In an alternative embodiment, glue patches 510 and 520 are applied to the outside surface of first flange 375 and second flange 385 (i.e., as folded in the first folding step).

Figure 6:
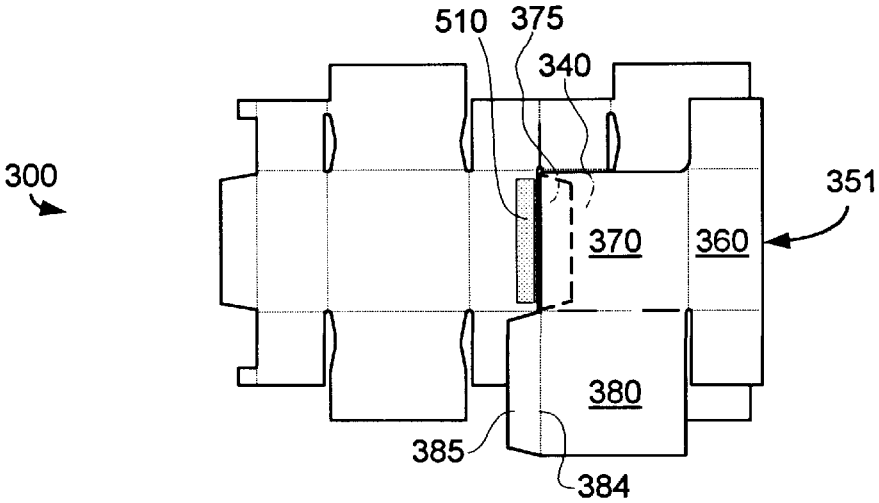
FIG. 6 is a plan view of the single-piece blank associated with the first embodiment after a third step of a folding and gluing process.

FIG. 6 shows a second folding step during which first flange 375 becomes permanently attached to end wall 340. Specifically, end wall panel 360, inside wall panel 370 and inside wall panel 380 are folded 180 degrees along fold line 351 relative to the remainder of single-piece blank 300. In FIG. 6, first flange 375 and end wall 340 are located under outside wall panel 370. First flange 375 remains folded 180 degrees relative to inside wall panel 370, as folded in the first folding step. First flange 375 is pressed against glue patch 520, thereby permanently attaching first flange 375 to end wall panel 340. During the second folding step, second flange 385 is released from its folded condition, and unfolds as shown in FIG. 6.

Figure 7A:
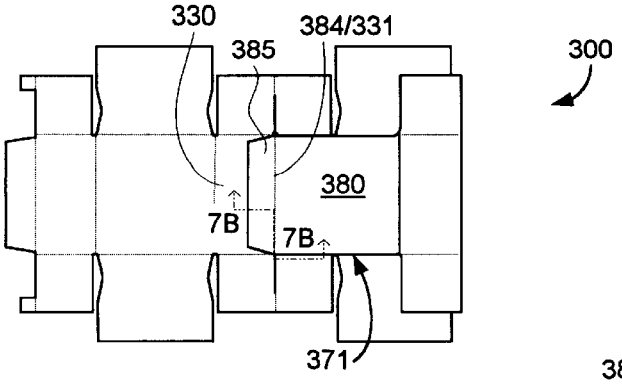
FIGS. 7(A) and 7(B) are a plan view and a sectional view, respectively, of the single-piece blank associated with the first embodiment after a fourth step of a folding and gluing process.
Figure 7B:
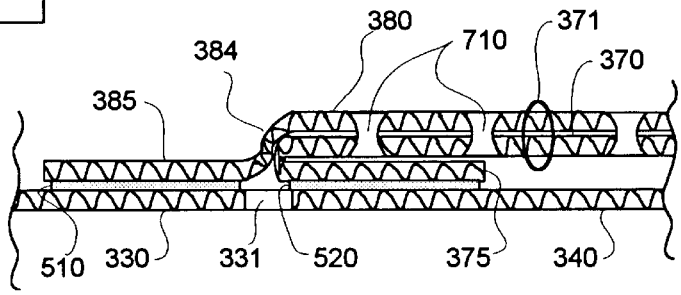

FIGS. 7(A) and 7(B) show a third folding step during which third flange 385 becomes permanently attached to end wall 330.

Referring to FIG. 7(A), inside wall panel 380 is back-folded 180 degrees along fold line 371 relative to inside wall panel 370. At the end of this folding step, the outside surface of second flange 385 is pressed against glue patch 510, whereby second flange 385 becomes permanently attached to end wall 330.

FIG. 7(B) is a side sectional view taken along line 7B—7B shown in FIG. 7(A). As shown, first flange 375 is permanently attached to end wall panel 340 by glue patch 520. Similarly, second flange 385 is permanently attached to end wall panel 330 by glue patch 510. Fold line 384 is located over slot 331, which is located between end wall panel 330 and end wall panel 340.

In accordance with one embodiment of the present invention, perforations in fold line 371 (shown in end view) are split during the third folding step. The split along fold line 371 is illustrated in FIG. 7(B), in which cut (perforated) portions of fold line 371 are opened to expose the corrugated material located therein, and uncut portions form joints 710 that temporarily connect inside wall panel 370 to inside wall panel 380. In an alternative embodiment, fold line 371 is slit along its entire length, and mechanical fasteners are provided that bridge inside wall panel 370 and inside wall panel 380. As discussed below, these temporary connections are severed/removed when the dual package container is separated into first and second packages.

Figure 8:
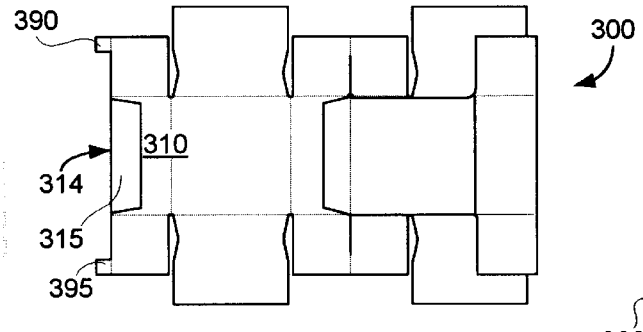
FIG. 8 is a plan view of the single-piece blank associated with the first embodiment after a fifth step of a folding and gluing process.

FIG. 8 shows a fourth folding step in which third flange 315 is folded 180 degrees relative to the remainder of single-piece blank 300. Third flange 315 is folded along fold line 314 until the inside (upper) surface of third flange 315 contacts inside surface of wall panel 310, and the outside (lower) surface of wall panel 310 faces upward. Note that first tab 390 and second tab 395 are not folded during the fourth folding step.

Figure 9:
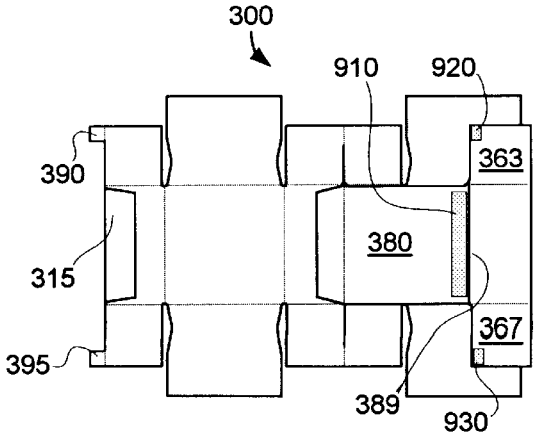
FIG. 9 is a plan view of the single-piece blank associated with the first embodiment after a sixth step of a folding and gluing process.

FIG. 9 shows a second gluing step in which an adhesive is deposited for permanently attaching third flange 315 to inside wall panel 380, and for permanently attaching first tab 390 and second tab 395 to top flap panel 363 and bottom flap panel 367, respectively. In the disclosed embodiment, glue patch 910 is deposited on the inside surface of inside wall panel 380 along edge 389 in pattern suitable for securing first flange 315. Referring briefly to FIG. 3, edge 389 of inside wall panel 380 is originally aligned with fold line 361. In addition, glue patch 920 is deposited on top flap panel 363 in a pattern and location suitable for securing first tab 390 upon subsequent folding. Glue patch 930 is simultaneously deposited on bottom flap panel 367 in a pattern and location suitable for securing first tab 395. In an alternative embodiment, glue patches 910, 920 and 930 are applied directly to third flange 315, first tab 390 and second tab 395.

Figure 10A:
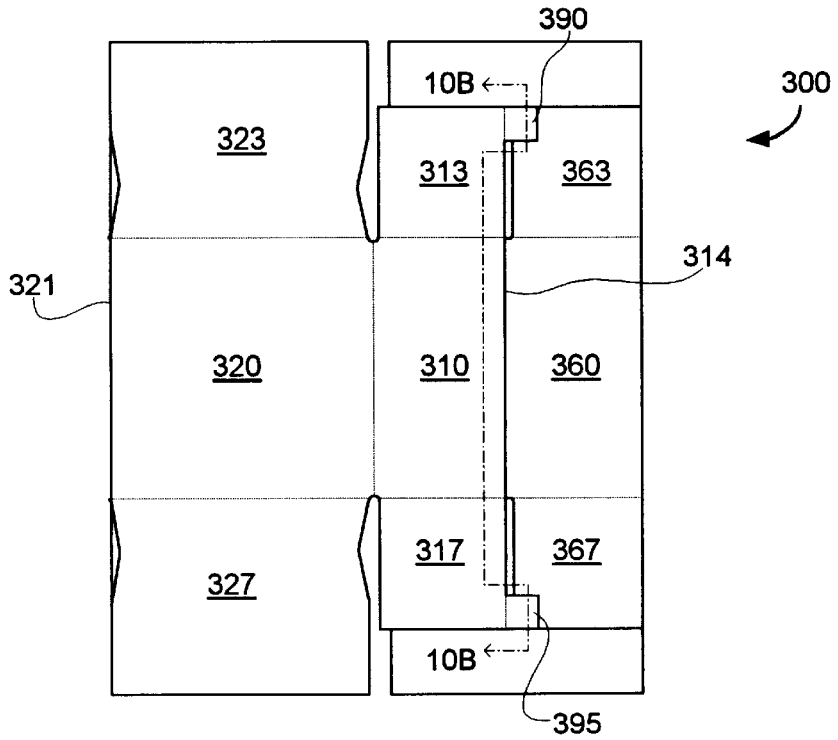
FIGS. 10(A) and 10(B) are a plan view and a sectional view, respectively, of the single-piece blank associated with the first embodiment in a flattened (knocked-down) state.
Figure 10B:
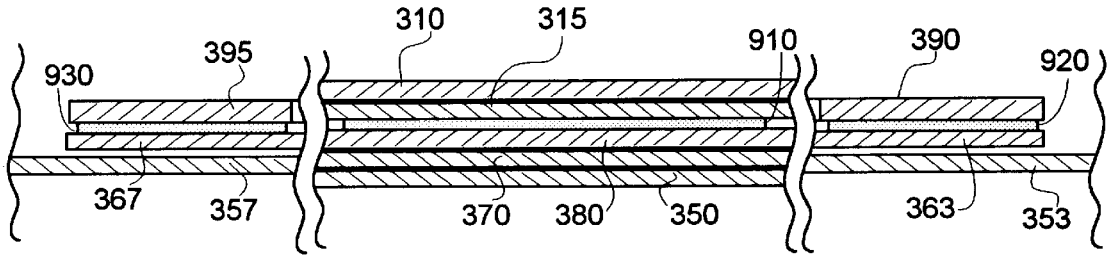

FIGS. 10(A) and 10(B) show a fifth folding step in which third flange 315 is permanently attached to inside wall 330, and tabs 390 and 395 are attached to flaps 363 and 367, respectively.

Referring to FIG. 10(A), end wall panel 310 and outside wall panel 320 are folded 180 degrees along fold line 321 relative to the remainder of single-piece blank 300. After this fold, the outside surface of third flange 315 contacts glue patch 910, and the inside surfaces of tabs 390 and 395 contact glue patches 920 and 930, respectively. Consequently, as shown in FIG. 10(B), third flange 315 is permanently attached to inside wall panel 380 by glue patch 910. In addition, first tab 390 is permanently attached to top flap panel 363 by glue patch 920, and second tab 395 is permanently attached to bottom flap panel 367 by glue patch 930. Note that third flange 315 is located under end wall panel 310 due to the fourth folding step shown in FIG. 8. In addition, outside wall panel 380 is located over inside wall panel 370 due to the third folding step shown in FIG. 7(A), and inside wall panel 370 is located over outside wall panel 350 due to the second folding step shown in FIG. 6.

As discussed above, top flap panel 313 is attached to top flap panel 363 to facilitate processing as a single major flap during subsequent folding and gluing steps. Similarly, bottom flap panel 317 is attached to bottom flap panel 367 to form a single major flap. The formation of these major flaps is most clearly seen in FIG. 10(A). Specifically, first tab 390 extends between top flap panels 313 and 363 are connected together to form a single flap structure, and second tab 395 is permanently attached between bottom flap panel 317 and bottom flap panel 367.

FIG. 10(A) shows single-piece blank 300 in a folded (knocked-down) state that is suitable for transportation to, for example, a glass house. In this state, single-piece blank 300 is essentially undistinguishable from conventional containers by the folding and gluing machinery utilized in the glass houses and wine producers-that is, no adjustments or modifications to these automated machines are required in order to handle the dual package containers of the present invention.

FIGS. 11(A) through 11(D) are perspective views illustrating a folding and gluing process whereby the bottom flaps of single-piece blank 300 are closed during the erection of a dual package container 1100 from the knocked-down blank 300 shown in FIG. 10(A). That is, when single-piece blank 300 is received by, for example, a glass house, it is erected (unfolded) by conventional automated methods into the three dimensional state shown in FIGS. 11(A) through 11(D). Specifically, the main panels of single-piece blank 300 are pivoted such that outside wall panel 350 is parallel to outside wall panel 320 and to inside wall panels 370 and 380, and end wall panels 310 and 360 are parallel to end wall panels 330 and 340. Subsequently, the bottom flaps are glued close the bottom opening of dual package container 1100 in the manner described below. Note that the top flap panels are intentionally omitted from these figures for clarity.

Figure 11A:
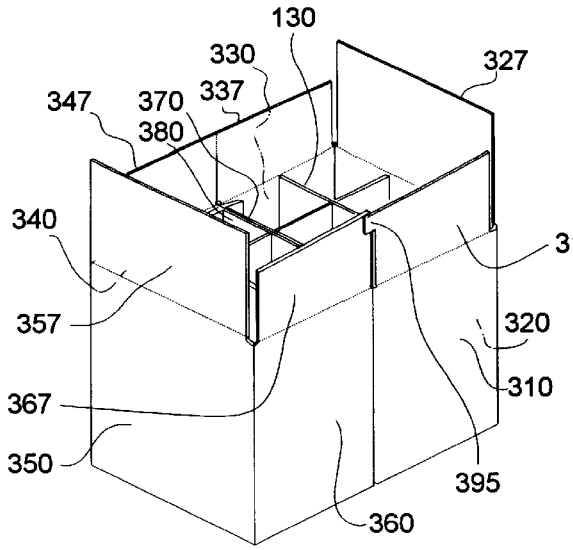
FIGS. 11(A), 11(B), 11(C) and 11(D) are perspective views showing a dual package container formed from the single-piece blank associated with the second embodiment during a bottom closing process.

FIG. 11(A) shows dual package container 1100 turned upside-down with the underside (bottom flap panels) extending upward. In practice, the underside of dual package container 1100 typically remains down. End wall panel 310, inside wall panel 380, end wall panel 330 and outside wall panel 320 form the interior of a first package of dual package container 1100. End wall panel 360, inside wall panel 370, end wall panel 340 and outside wall panel 350 form the interior of a second package of dual package container 1100. Partitioning walls 130 are inserted into the interior of the first package and the second package to form, for example, six compartments in each package.

Figure 11B:
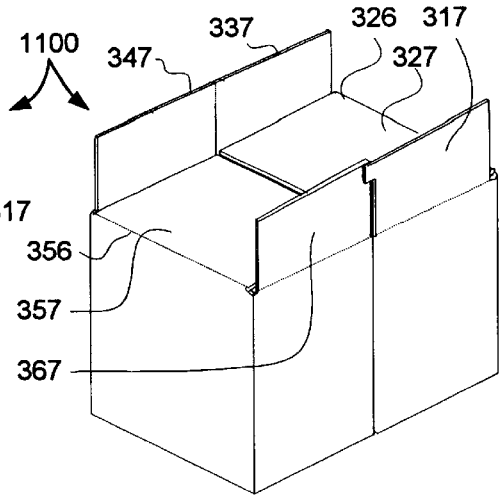

FIG. 11(B) shows a first folding step in which bottom panel walls 327 and 357 are folded 90 degrees to close the bottom opening of dual package container 1100. Bottom flap panel 327 is folded along fold line 326 from a vertical position to a horizontal position. Bottom flap panel 357 is folded along fold line 356 from a vertical position to a horizontal position. Bottom flap panels 317, 337, 347 and 367 remain perpendicular to bottom flap panels 327 and 357 during this first folding step.

Figure 11C:
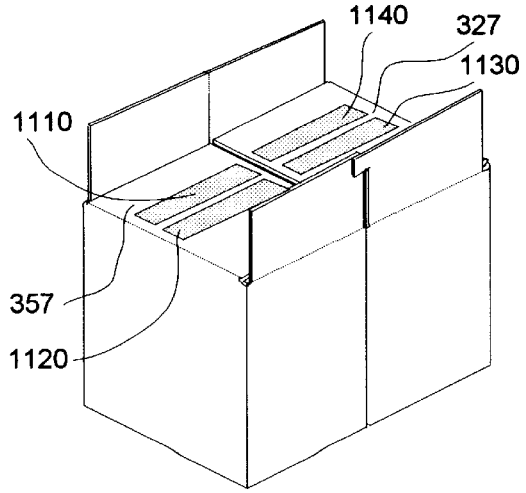

FIG. 11(C) shows a gluing step in which glue is deposited on the folded bottom flap panels 327 and 357. Specifically, a first elongated glue patch 1110 and a second glue patch 1120 are deposited on bottom flap panel 357. Similarly, a third elongated glue patch 1130 and a fourth glue patch 1140 are deposited on bottom flap panel 327.

Figure 11D:
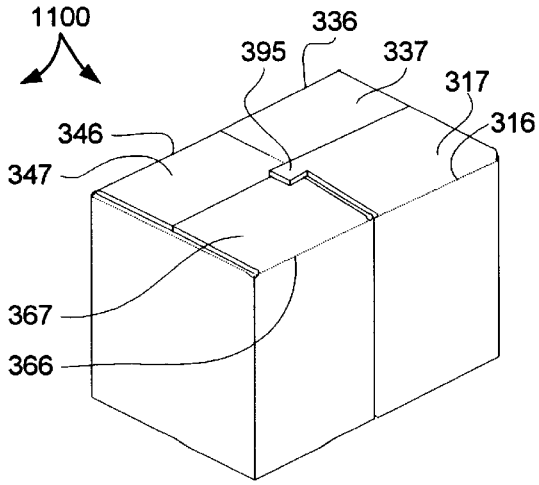

FIG. 11(D) shows a subsequent folding step in which bottom flap panels 317, 367, 337 and 347 are pressed against glue patches 1130, 1120, 1140 and 1130, respectively, thereby securing these flaps to bottom flap panels 327 and 357. Specifically, bottom flap panels 317 and 367 are folded along fold lines 316 and 366 from a vertical position to a horizontal position, and respectively contact glue patches 1130 and 1120 (shown in FIG. 11(C)). Bottom flap panels 337 and 347 are folded along fold lines 336 and 346 from a vertical position to a horizontal position, and respectively contact glue patches 1140 and 1110 (shown in FIG. 11(C)). After the third folding step is completed and the adhesive dries, bottom flap panels 317, 337, 347 and 367 become permanently attached to bottom flap panels 327 and 357, thereby permanently closing the underside of dual package container 1100.

After the underside of dual package container 1100 is permanently closed, twelve empty bottles are inserted through the open upper end of dual package container 1100 such that one empty bottle is received in each of the compartments defined by partitioning walls 130. Dual package container 1100 is then shipped, for example, to a winery where the empty bottles are removed, filled and sealed, and then replaced into the spaces formed by partitioning walls 130. The top flap panels of dual package container 1100 are then folded and glued in a manner similar to that shown in FIGS. 11(A) to 11(D) and described above, thereby forming a sealed, integral dual package container holding twelve bottles.

In accordance with another aspect of the present invention, dual package container 1100 can be transported as an integral, twelve-bottle container that is commonly utilized in the U.S., or separated into two six-bottle packages that are commonly utilized in Europe. That is, the temporary connections between the first and second packages of dual package container 1100 are constructed to withstand normal shipping stresses such that these packages are held together as an integral unit. In contrast, the temporary connections between the first and second packages are breakable upon the application of a specific separating force to allow separation of the packages. The following description covers this separation process.

Figure 12A:
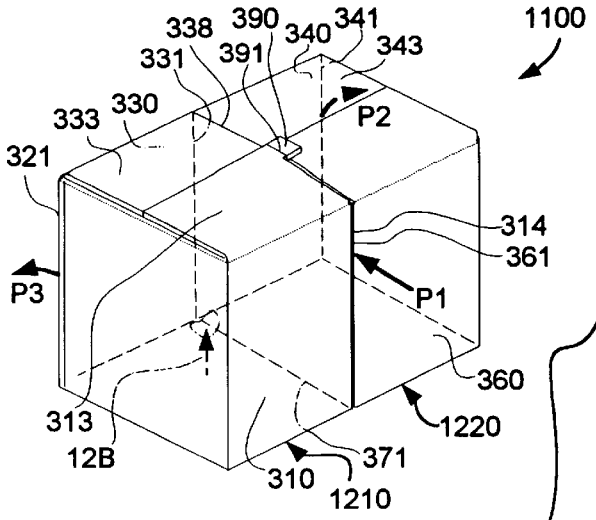
FIGS. 12(A), 12(B) and 12(C) are perspective, sectional, and perspective views, respectively, showing the dual package container of the second embodiment during a separation process wherein the dual package container is separated into two packages.
Figure 12B:
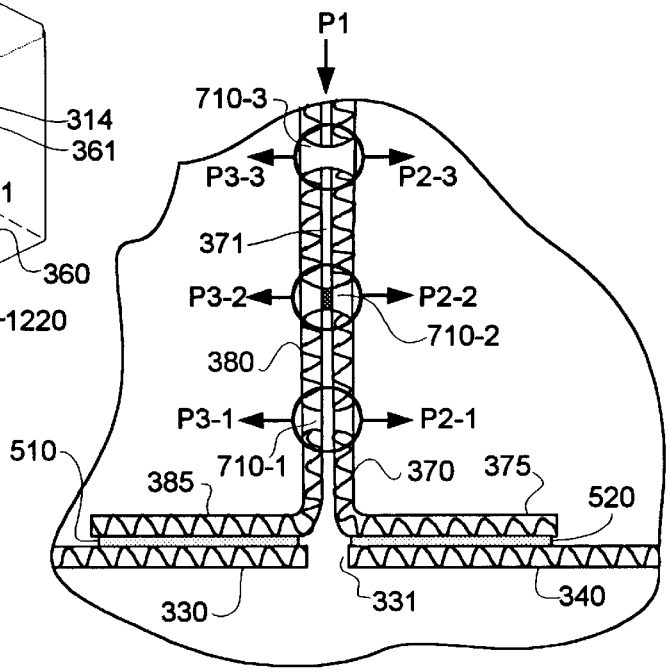
Figure 12C:
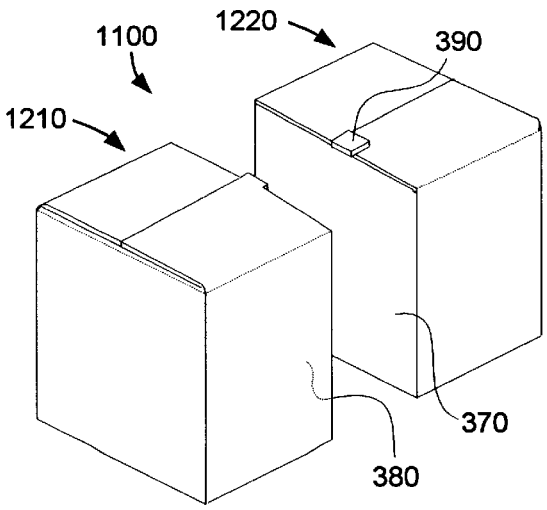

FIGS. 12(A) through 12(C) illustrate a separating process whereby dual package container 1100 is separated into a first package 1210 and a second package 1220.

FIG. 12(A) is a perspective view showing forces applied to dual package 1100 in accordance with an embodiment of the separating process. A pushing force P1 is applied to end wall panels 310 and 360 adjacent centrally-located vertical fold lines 314 and 361. Simultaneously, pulling forces P2 and P3 are respectively applied in opposing directions to the corners of first package 1210 (i.e., at fold line 321) and second package 1220 (i.e., at fold line 341). The combined forces P1, P2 and P3 create a torque that pulls apart the temporary connections holding the first and second packages together. The applied forces are initially greatest adjacent end walls 330 and 340, and then propagate along fold line 371 toward fold lines 314 and 361. As the forces propagate along fold line 371, the temporary connection created by perforating fold line 338 is broken, thereby separating top flap panel 333 from top flap panel 343. As the forces further propagate along fold line 371, the temporary connection created by perforating fold line 391 is broken, thereby separating tab 390 from top flap panel 313. Similarly, the temporary connection along fold line 396 is broken, thereby separating tab 395 from bottom flap panel 317 (not shown). Finally, the propagating forces break the temporary connections (i.e., joints 710 shown in FIG. 7(B)) that are formed along fold line 371.

FIG. 12(B) is a cutaway bottom view showing the separation process associated with a portion of the fold line 371. FIG. 12(B) is viewed along line 12B in FIG. 12(A). As the pulling forces propagate along fold line 371, force component pair P2-1 and P3-1 is applied to joint 710-1, force component pair P2-2 and P3-2 are applied to joint 710-2, and force component pair P2-3 and P3-3 are applied to joint 710-3. Force component pair P2-1 and P3-1 is greater than force component pair P2-2 and P3-2 because joint 710-1 is located closer to end wall panels 330 and 340 than joint 710-2. Similarly, force component pair P2-2 and P3-2 is greater than force component pair P2-3 and P3-3 because joint 710-2 is located closer to end wall panels 330 and 340 than joint 710-3. Therefore, as indicated in FIG. 12(B), the greater force components applied by force component pair P2-1 and P3-1 tend to pull apart joint 710-1 (shown already separated) before force component pair P2-2 and P2-3 pulls apart joint 710-2 (shown partially torn). Note that flanges 375 and 385 remain permanently attached to end wall panels 340 and 330, respectively, by glue patches 520 and 510.

FIG. 12(C) is a perspective view showing twelve-bottle dual package container 1100 totally separated into six-bottle packages 1210 and 1220. Package 1210 is completely enclosed due to inside wall 380, which is exposed when package 1210 is separated from package 1220. Similarly, package 1220 is completely enclosed due to inside wall 370. Note that tab 390 remains attached to top flap panel 363. Tab 390 can be subsequently removed if desired.

Third Embodiment

Figure 13:
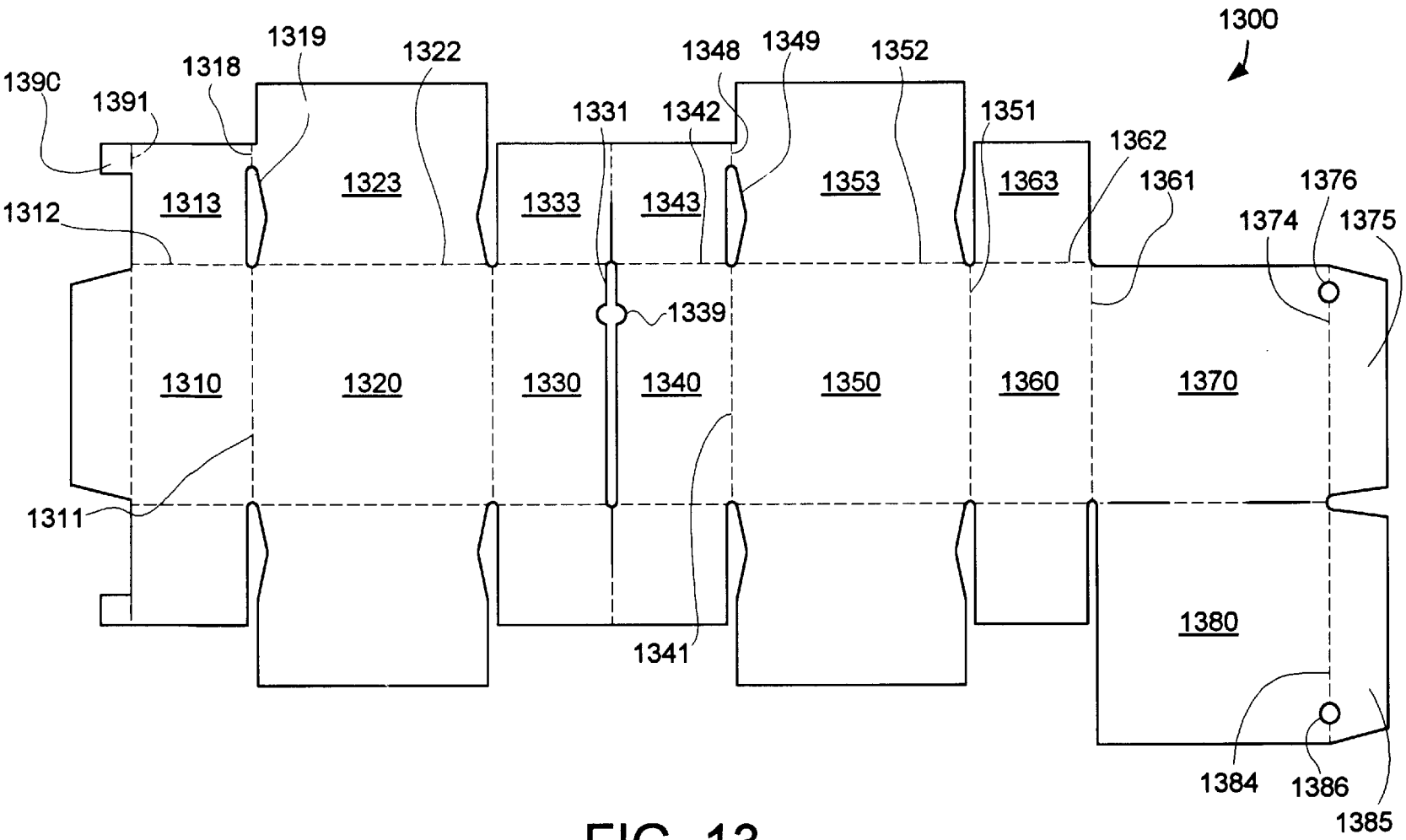
FIG. 13 is a plan view showing a single-piece blank for forming a dual package container in accordance with a third embodiment of the present invention.

FIG. 13 is a plan view of a single-piece blank 1300 used to form a dual package container in accordance with a third embodiment of the invention. Many portions of single-piece blank 1300 are similar to corresponding portions of blank 300 (see FIG. 3). In the following description, only differences between blanks 300 and 1300 will be discussed.

In accordance with an aspect of the third embodiment, top flap panels 1313 and 1323 are connected together, as are top flap panels 1343 and 1353, to hold open the upper portion of a dual package container during the bottle insertion process. Specifically, single-piece blank 1300 is formed with coat-hanger shaped openings 1319 and 1349. Opening 1319 is located between top flap panel 1313 and top flap panel 1323. A lower portion of opening 1319 is located at the intersection of fold lines 1311, 1312 and 1322. Opening 1319 is located below the upper edge of top flap panel 1313, thereby leaving a short fold line 1318 extending from the top flap panel 1313 to opening 1319. Opening 1349 is located between top flap panel 1343 and top flap panel 1353. A lower portion of opening 1349 is located at the intersection of fold lines 1341, 1342 and 1352. Opening 1349 is located below the upper edge of top flap panel 1343, thereby leaving a short fold line 1348 extending from the top flap panel 1343 to opening 1349. As discussed below, the top flap panels of single-piece blank 1300 are held together by short fold lines 1318 and 1348.

In accordance with another aspect of the third embodiment, single-piece blank 1300 includes circular openings 1339, 1376 and 1386 that are provided to facilitate manual separation of the dual package container into individual packages. Opening 1339 is located on slot 1331 between end wall panel 1330 and end wall panel 1340. Opening 1376 is located on fold line 1374 between inside wall panel 1370 and flange 1375. Opening 1386 is located on fold line 1384 between inside wall panel 1380 and flange 1385. Openings 1339, 1376 and 1386 are vertically aligned such that they coincide when single-piece blank 1330 is folded.

Figure 14A:
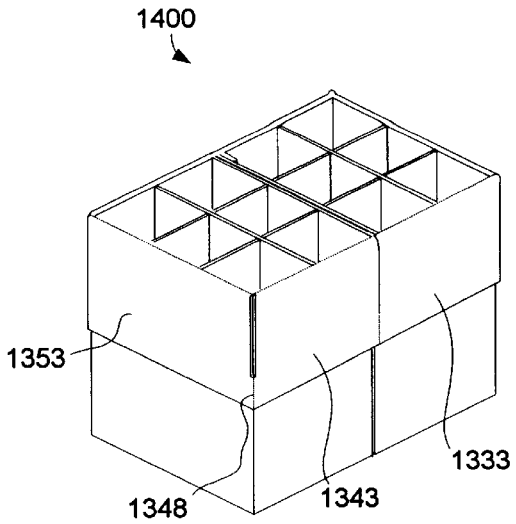
FIGS. 14(A) and 14(B) are perspective views showing a dual package container formed from the single-piece blank associated with the third embodiment during a top closing process.
Figure 14B:
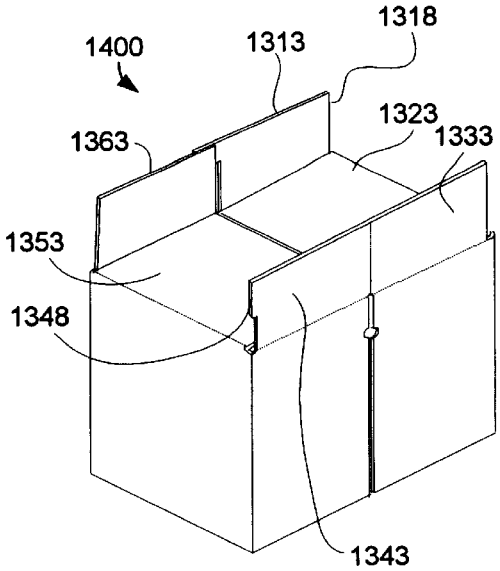

FIGS. 14(A) and 14(B) illustrate portions of a cutting and folding process wherein the top flap panels of single-piece blank 1300 are folded to close the upper opening of dual package container 1400. When initially formed, the top flaps are back-folded 180 degrees to contact the outside surface of the walls of dual package container 1400, as shown in FIG. 14(A). The cutting and folding process is performed after bottles are inserted into the compartments defined by partitioning walls 130. During the bottle insertion process, the top flaps of dual package container 1400 are held open due to the connection along fold line 1348 between top flap panels 1343 and 1353, and due to the connection along fold line 1318 and between top flap panels 1313 and 1323 (not shown in FIG. 14(B)).

As shown in FIG. 14(B), top flap panels 1343 and 1353 are first separated by cutting along fold line 1348, then top flap panel 1353 is folded 270 degrees from its original vertical position to the horizontal position shown. Top flap panels 1313 and 1323 are also separated by cutting along fold line 1318, and folding top flap panel 1323 from its original vertical position to the horizontal position shown. Other steps of the folding and gluing process are essentially identical to those described above, and are therefore omitted for brevity.

Figure 15A:
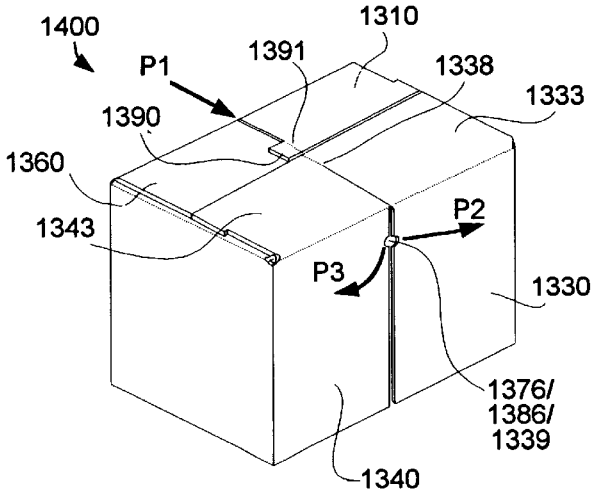
FIGS. 15(A) and 15(B) are perspective views showing the dual package container of the third embodiment during a separation process wherein the dual package container is separated into two packages.
Figure 15B:
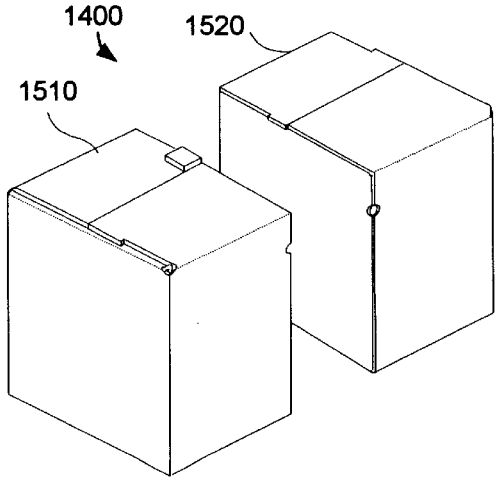

FIGS. 15(A) through 15(B) illustrate a separating process whereby dual package container 1400 is separated into a first package 1510 and a second package 1520. FIG. 15(A) shows the application of forces P1, P2 and P3 to dual package container 1400 in accordance with the third embodiment. Force P1 is applied in the direction shown in FIG. 15(A), and forces P2 and P3 are applied by pulling the respective packages outward. For example, a worker applies force P1 by pulling dual package container 1400 against the worker's chest. Forces P2 and P3 are applied by inserting the workers fingers through openings 1339, 1376 and 1386, and then pulling outward.

FIG. 15(B) shows dual package container 1400 separated into a first package 1510 and a second package 1520.

Fourth Embodiment

Figure 16:
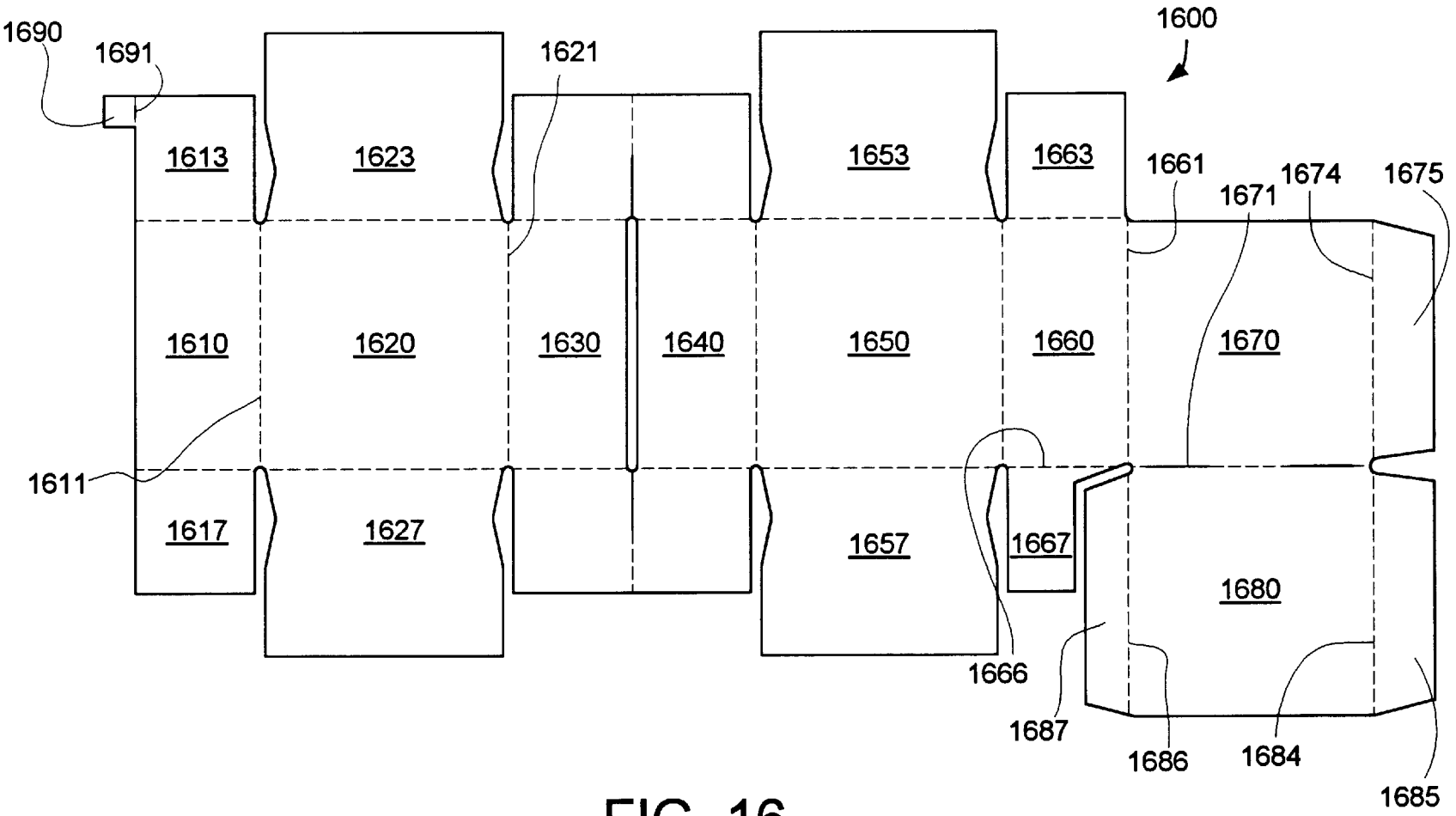
FIG. 16 is a plan view showing a single-piece blank for forming a dual package container in accordance with a fourth embodiment of the present invention.

FIG. 16 is a plan view of a single-piece blank 1600 used to form a dual package container in accordance with a fourth embodiment of the invention. Many portions of single-piece blank 1600 are similar to corresponding portions of blank 300 (see FIG. 3). In the following description, only differences between blanks 300 and 1600 will be discussed.

Single-piece blank 1600 is characterized by forming a third flange 1687 on inside wall panel 1680. Specifically, third flange 1687 is permanently connected to inside wall panel 1680 along a vertical fold line 1686, wherein the second wall panel 1680 is located between the second flange 1685 and the third flange 1687. To facilitate this modified structure, bottom flap panel 1667 is formed with a narrower width, as compared to that of bottom flap panel 367 (see FIG. 3). In addition, tab 395 is eliminated because the modified structure does not provide for easily adherence of such a tab to bottom flap panel 1667.

Figure 17A:
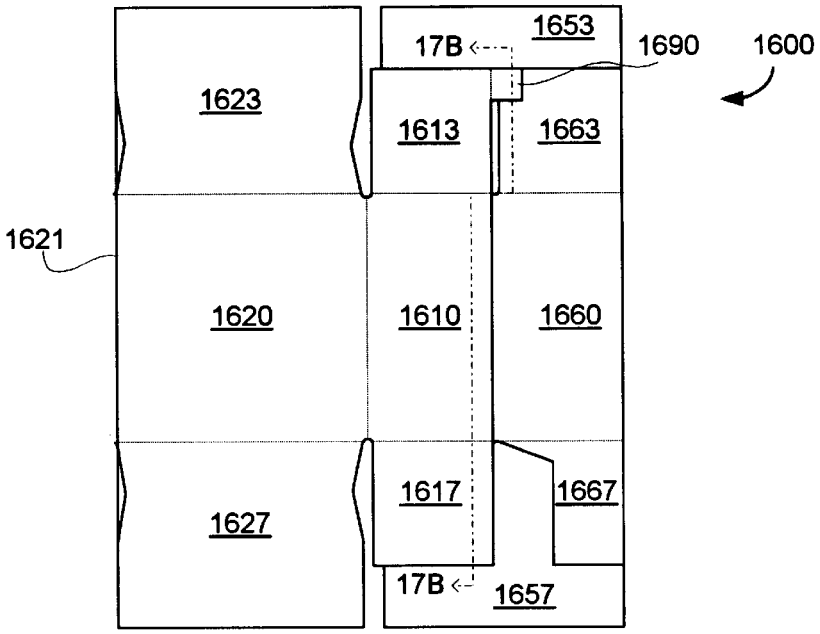
FIGS. 17(A) and 17(B) are a plan view and a sectional view, respectively, of the single-piece blank associated with the fourth embodiment in a flattened state.
Figure 17B:
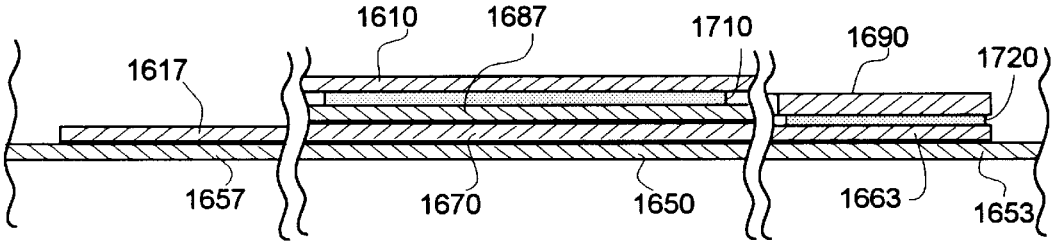

FIGS. 17(A) and 17(B) are a plan view and a sectional view, respectively, of the single-piece blank associated with the fourth embodiment in a flattened state. The folding and gluing process utilized for single-piece blank 1600 is similar to that described above for blank 300 with the following exceptions described with reference to FIGS. 17(A) and 17(B).

In a first exception to the previously-described folding and gluing process, instead of folding flange 315 (see FIG. 8), third flange 1687 is folded 180 degrees during the third folding step. As shown in FIGS. 17(A) and 17(B), the resulting flattened (knocked-down) container 1600 includes glue portion 1710 between end wall panel 1610 and third flange 1687, with inside wall panel 1670 and outside wall panel 1650 located thereunder. Subsequent steps of the folding and gluing process are essentially identical.

FIGS. 17(A) and 17(B) also illustrate a second exception to the folding and gluing process—namely, the bottom flap panels 1617 and 1667 are not connected by a glue tab. Referring back to FIG. 2, glue tab 395 of the second embodiment is connected between panels 317 and 367. However, as shown in FIGS. 17(A) and 17(B), bottom flap panel 1667 is displaced from bottom flap panel 1617, which directly contacts outside wall panel 1657. Therefore, single-piece blank 1600 may require minor adjustment to the folder/gluer used to close the bottom flaps of a subsequently erected dual package container. Specifically, because the bottom flap panels 1617 and 1667 are not connected, the folder/gluer must be able to fold both of these flaps independently.

Although the present invention has been described with respect to certain specific embodiments, it will be clear to those skilled in the art that the inventive features of the present invention are applicable to other embodiments as well, all of which are intended to fall within the scope of the present invention. For example, the specific measurements (e.g., panel height and width) associated with the disclosed single-piece blank may be altered without changing the benefits provided by the present invention. Further, the disclosed container may be modified to form, for example, a single twenty-four-can container that can be separated into two twelve-can packages, thereby allowing the elimination of the cardboard tray typically utilized to transport "twelve pack" soda containers

I claim:

1. A dual package container comprising:

a first package including a first inside wall, a first outside wall, and first and second end walls, the first inside wall being parallel to the first outside wall and perpendicular to the first and second end walls, the first package also including a first flange permanently connected to an edge of the first inside wall, the first flange being permanently attached to the second end wall of the first package; and a second package including a second inside wall, a second outside wall, and third and fourth end walls, the second inside wall being parallel to the second outside wall and perpendicular to the third and fourth end walls, wherein the first side wall of the first package is parallel to and abuts the third side wall of the second package, the second package also including a second flange permanently connected to an edge of the second inside wall, the second flange being permanently attached to the fourth end wall of the second package;

wherein the first inside wall is temporarily connected to the second inside wall along an edge extending between the first and second end walls; and wherein the first package and the second package are formed from a single-piece blank.

2. The dual package container according to claim 1, wherein the container further comprises:

a third flange permanently connected to an edge of the third end wall 122, the third flange being permanently attached to the second inside wall of the second package.

3. The dual package container according to claim 2, wherein the first flange, the second flange, and the third flange are permanently attached to the second end wall, the fourth end wall, and the third end wall, respectively, by an adhesive.

4. The dual package container according to claim 2, wherein the first package further comprises a plurality of first partitioning walls dividing an interior of the first package into a plurality of compartments, and the second package further comprises a plurality of partitioning second walls dividing an interior of the second package into a plurality compartments.

5. A single-piece blank for forming a dual package container, the single-piece blank comprising:

a plurality of main panels sequentially arranged along a first direction, each main panel having at least one edge connected to an adjacent main panel by a fold line extending in a second direction that is perpendicular to the first direction, wherein the plurality of main panels includes a first inside wall panel located at a first end of the plurality of main panels, the first inside wall panel having a first edge extending in the first direction and a second edge extending in the second direction;

a second inside wall panel temporarily connected to the first inside wall panel along a first fold line, the first fold line extending in the first direction, whereby the second inside wall panel extends perpendicular to the plurality of main panels;

a first flange permanently connected to the first wall panel along a second fold line, the second fold line extending in the second direction; and a second flange permanently connected to the second wall panel along a third fold line, the third fold line extending in the second direction.

6. The single-piece blank according to claim 5, first end wall panel located at a second end of the plurality of main panels; and wherein the single-piece blank further comprises a third flange permanently connected to the first end wall panel along a fourth fold line, the fourth fold line extending in the second direction.

7. The single-piece blank according to claim 6, wherein the plurality of main panels further [comprising:] comprises:

a second end wall panel permanently connected to the first inside wall panel along a fifth fold line, the fifth fold line extending in the second direction;

a first top flap panel permanently connected to the fourth wall panel along a sixth fold line, the sixth fold line extending in the first direction; and a second top flap panel permanently connected to the first end wall panel along a seventh fold line, the seventh fold line extending in the first direction;

wherein the blank further comprises a first tab temporarily connected to the second top flap panel along an eighth fold line, the seventh fold line extending in the second direction.

8. The single-piece blank according to claim 7, further comprising:

a first bottom flap panel permanently connected to the second end wall panel along a ninth fold line, the ninth fold line extending in the first direction;

an second bottom flap panel permanently connected to the first end wall panel along a tenth fold line, the tenth fold line extending in the first direction; and a second tab temporarily connected to the second bottom flap panel along an eleventh fold line, the eleventh fold line extending in the second direction.

9. The single-piece blank according to claim 5, wherein the plurality of main panels further comprises:

a first end wall panel; and a second end wall panel located adjacent to and separated from the first wall panel by an elongated slot, the elongated slot extending in the second direction.

10. The single-piece blank according to claim 9, further comprising:

a first opening located between the first inside wall panel and the first flange on the second fold line; and a second opening located between the second inside wall panel and the second flange on the third fold line.

11. The single-piece blank according to claim 9, wherein the plurality of main panels further comprises a first outside wall panel permanently connected to the second end wall panel along a fourth fold line, the fourth fold line extending in the second direction; and wherein the blank further comprises:

a first top flap panel permanently connected to the second end wall panel along a fifth fold line, the fifth fold line extending in the first direction;

a second top flap panel permanently connected to the first outside wall panel along a sixth fold line, the sixth fold line extending in the first direction;

wherein the first top flap panel is connected to the second top flap panel along a seventh fold line, and wherein the single-piece blank defines an opening located between the seventh fold line and an edge of the first outside wall panel.

12. The single-piece blank according to claim 5, further comprising:

a third flange permanently connected to the second inside wall panel along a fourth fold line, the fourth fold line extending in the second direction, wherein the second inside wall panel is located between the second flange and the third flange.

13. A dual package container comprising:

a first package including a first inside wall panel, a first end wall panel, a first outside wall panel permanently connected to the first end wall panel along a first fold line, and a second end wall panel permanently connected to the first outside wall panel along a second fold line; and a second package including a second inside wall panel, a third end wall panel permanently connected to the second inside wall panel along a third fold line, a second outside wall panel permanently connected to the third end wall panel along a fourth fold line, and a fourth end wall panel permanently connected to the second outside wall panel along a fifth fold line;

wherein the first inside wall panel is connected to the second inside wall panel along a sixth fold line extending between the first end wall panel and the second end wall panel, and wherein the sixth fold line is perforated such that the first inside wall panel is separable from the second inside wall panel, whereby the first package is separated from the second package.

14. The dual package container according to claim 13, wherein the container further comprises:

a first flange permanently connected to an edge of the first inside wall panel along a seventh fold line, the first flange being permanently attached to the second end wall panel;

a second flange permanently connected to an edge of the second inside wall panel along an eighth fold line, the second flange being permanently attached to the fourth end wall panel; and a third flange permanently connected to an edge of the first end wall panel along a ninth fold line, the third flange being permanently attached to the first inside wall panel.

15. The dual package container according to claim 14, further comprising:

a first adhesive portion connecting the first flange to the second end wall panel;

a second adhesive portion connecting the first flange to the fourth end wall panel; and a third adhesive portion connecting the third flange to the first inside wall panel.

16. The dual package container according to claim 13, wherein the container further comprises:

a first bottom flap panel permanently connected to the first end wall panel along a seventh fold line;

a tab connected to the first bottom flap panel along an eighth fold line;

a second bottom flap panel permanently connected to the third end wall panel along a ninth fold line;

an adhesive portion connecting the tab to the second bottom flap panel;

wherein the eighth fold line is perforated such that the tab is separable from the first bottom flap panel, thereby separating the first package from the second package.

17. The dual package container according to claim 13, wherein the container further comprises:

a first flange permanently connected to the first inside wall panel along a seventh fold line, the first flange being permanently attached to the second end wall panel;

a second flange permanently connected to an edge of the second inside wall panel along an eighth fold line, the second flange being permanently attached to the fourth end wall panel; and a third flange permanently connected to a second edge of the second inside wall panel along a ninth fold line, the third flange being permanently attached to the first end wall panel.

18. The dual package container according to claim 13, wherein the first package further comprises a plurality of first partitioning walls dividing an interior of the first package into a plurality compartments, and the second package further comprises a plurality of partitioning second walls dividing an interior of the second package into a plurality compartments.

* * * * *

UNITED STATES PATENT AND TRADEMARK OFFICE

CERTIFICATE OF CORRECTION

PATENT NO. : 6,006,982

DATED : December 28, 1999

INVENTOR(S) : Benjamin M. Jones

It is certified that error appears in the above-identified patent and that said Letters Patent is hereby corrected as shown below:

Title page, item [73], Assignee: insert Pacific Southwest Container, Modesto, CA.

Signed and Sealed this

Twenty-fourth Day of October, 2000

*Attest:*

Q. TODD DICKINSON

*Attesting Officer*

*Director of Patents and Trademarks*